313-414.
2-3-76 OR 3,936,692

United States Patent [19]
Izumida et al.

[11] 3,936,692
[45] Feb. 3, 1976

[54] ELECTRON GUN ASSEMBLY FOR USE IN MULTI-BEAM TYPE CATHODE RAY TUBE

[75] Inventors: Yukihiro Izumida, Mobara; Kihachiro Koizumi; Yoshihiko Miyata, both of Chiba, all of Japan

[73] Assignee: Hitachi, Ltd., Tokyo, Japan

[22] Filed: Aug. 5, 1974

[21] Appl. No.: 494,754

[30] Foreign Application Priority Data

Aug. 8, 1973 Japan ..... 48-88423

[52] U.S. Cl. ..... 313/414; 313/417
[51] Int. Cl.[2] ..... H01J 29/50; H01J 29/51; H01J 29/82
[58] Field of Search ..... 313/409, 414, 412

[56] References Cited

UNITED STATES PATENTS 3,772,554 11/1973 Hughes ..... 313/414 X

*Primary Examiner*—Robert Segal
*Attorney, Agent, or Firm*—Charles E. Pfund, Esq.

[57] ABSTRACT

In an electron gun assembly for use in multi-beam type cathode ray tube of the type including a plurality of grid structures in which the groups of the grid electrodes of respective guns are formed as integral units, the grid electrodes of each group are impressed with the same potential and perform the same function, and wherein an electron lens is formed between adjacent grid structures, an assembly of a plate member or a superposed plate member is secured to one or both of the opposing ends of the grid structures. Each plate member is provided with a plurality of openings which are arranged to correspond to a predetermined arrangement of a plurality of electron guns, and each opening is surrounded by an axial edge. The edges function to prevent electric fields formed by the openings from being affected by the side walls of the grid structures opposing the openings thereby decreasing the astigmatism of the main electron lens.

7 Claims, 8 Drawing Figures

ELECTRON GUN ASSEMBLY FOR USE IN MULTI-BEAM TYPE CATHODE RAY TUBE

BACKGROUND OF THE INVENTION

This invention relates to a multi-beam type electron gun assembly having a plurality of electron guns and more particularly to an electron gun assembly for use in a multi-beam type cathode ray tube including an improved grid structure wherein the identical grid electrodes of respective electron guns are formed as an integral structure.

Generally, a three-beam type electron gun assembly as a typical example of the multi-beam type electron gun assembly for use in the cathode ray tube is often utilized in a colour picture tube in which three electron guns are disposed in the neck of the envelope of a colour picture tube which comprises a panel, a funnel and the neck. Each electron gun comprises a first grid electrode provided with a cathode or a cathode heater and a plurality of other grid electrodes aligned in the direction from the neck to panel of the envelope of the picture tube to follow the first grid electrode. These grid electrodes are impressed with the predetermined potential so as to form a prefocussing lens system and a main focussing lens system between the predetermined ones of the electrodes.

In the prior art construction of the electron gun assembly of the type referred to above it is usual to assemble three independent electron guns together on a supporting member such as made of beads glass by taking a triangle or in-line position. However, in assembling the three independent electron guns together on the beads glass supporting member there are such difficulties that it is necessary to align respective electron guns in the axial direction and to assemble the electron guns in correct relative positions. Moreover, this construction increases the number of component elements and hence the cost of assembling them so that the size and the weight of the electron gun assembly cannot be reduced beyond certain limits.

To obviate these difficulties, in recent years, it has been proposed to construct as an integral unit a particular group of grid electrodes among the grid electrodes of respective electron guns, the grid electrodes to be grouped being impressed with the same potential and presenting the same function. According to this construction, it is possible to decrease the number of the component elements, to simplify the assembling work and to reduce the size and weight relative to the prior art construction. Especially integral formation of respective identical grids constituting a main focussing lens results in an elevated accuracy for assembling an electron gun assembly, thus the characteristics of the electron gun assembly are enhanced to a great extent. This integral grid is formed by the following method. First a cup shaped member is formed, the bottom of which is provided with three openings arranged in the predetermined position, each opening being used for the passage of electron beams respectively traveling within each electron gun assembled, and has a predetermined diameter. Then another cup shaped member is formed having a bottom provided with openings coaxial with the openings of the first mentioned cup shaped member, each opening being used for the same purpose as in said first mentioned cup shaped member. These two cup shaped member are disposed to oppose each other with a predetermined spacing between the bottoms and the openings thereof correspond with each other thus assembling the integrally formed grid electrode. According to this construction, the openings of respective bottoms will not be positioned at an equal distance from the side walls of the opposing cup shaped members unless the cross section of the cup shaped member is circular and the axes of openings coincides with that of said cup shaped member. Under these conditions, when a predetermined potential is impressed upon the pair of cup shaped members spaced from each other a predetermined distance, the potential distribution between opposing openings will necessarily be affected by the side walls of the opposing cup shaped members. In other words, the potential distribution, which otherwise would be rotationally symmetrical with respect to the axes of the openings, will be greatly affected by the edge effect of the side walls and that of the openings. Accordingly to obviate such an adverse effect it was proposed to provide a cylindrical tube along the peripheries of the openings axially towards the inside of the cup shaped members so as to eliminate the above-mentioned effect. To form the cup shaped member, press work is desirable in view of easiness and accuracy in the process. However, it is impossible to obtain such cup shaped member that has a useful edge integrally formed along the peripheries of the openings having the same function as the above-mentioned cylindrical tube because the depth attained through the press process has to be limited with the relationship between the diameter of the openings and the permissible pressed depth in connection with a raw material and so forth. Accordingly the effect of such press work is only to increase the breakdown voltage of the opposing grid structures. That is to say, constituting the electron lens system with the grid in which inadequate pressed depth is achieved compared with the opening diameter results in such nonuniform potential distribution between opposed openings as to cause an asymmetry with respect to the axis of the electron lens which in turn results in the increase in the astigmatism of the lens.

SUMMARY OF THE INVENTION

Accordingly, it is an object of this invention to provide an improved multi-beam type electron gun assembly for use in a cathode ray tube in which the grid electrodes of respective electron guns are impressed with the same potential and having the same function are constructed as an integral structure and including a grid structure providing a uniform potential distribution therewith.

Another object is to provide an improved multi-beam type electron gun assembly for use in a cathode ray tube including a novel structure that can decrease the astigmatism of the electron lens system, thus improving the focussing characteristics thereof.

Still another object of this invention is to provide an improved multi-beam type electron gun assembly including a main electron lens having a small astigmatism and being suitable for use in a cathode ray tubes for producing clear and sharp images.

According to this invention, these and further objects can be accomplished by providing a multi-beam type electron gun assembly for use in a cathode ray tube of the type including at least two grid structures in which the groups of the grid electrodes of respective electron guns are formed as an integral unit, the grid electrodes of each group are impressed with the same potential and perform the same function, and wherein a main electron lens is formed between adjacent grid structures, characterized in that an assembly of superposed plate members is secured to at least one of the opposing ends of the grid structures by welding and the like, that each plate member is provided with a plurality of openings which are arranged to correspond to a predetermined arrangement of a plurality of electron guns, that axial edges are formed to surround respective openings, and that the edges function to prevent electric fields formed in the openings from being affected by the side walls of the grid structures opposing the openings thereby decreasing the astigmatism of the electron lens formed at the openings.

A pair of plate members are superposed such that the axial edges of different plate members oppose each other or extend in the same direction.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
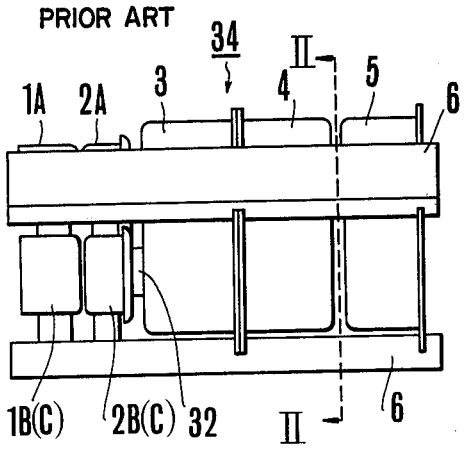
FIG. 1 PRIOR ART
FIG. 1 is a diagrammatic representation showing one example of the construction of an electron gun assembly including a prior art grid structure.
Figure 2:
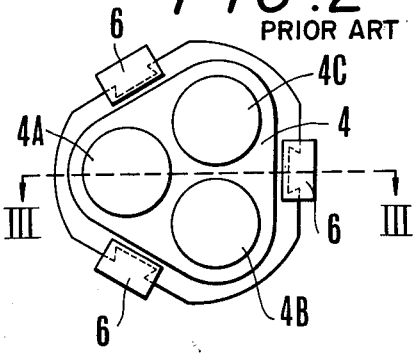
FIG. 2 PRIOR ART
FIG. 2 shows a sectional view of the electron gun structure shown in FIG. 1 take along a line II —II.

In recent years an electron gun assembly as shown in FIG. 1 has been proposed and used in view of various advantages involved. The construction is characterized in that a particular group of the grid electrodes of respective electron guns impressed with the same potential and performing the same function are formed as an integral grid structure unit through press work for the purpose of eliminating the disadvantage of assembling three independent electron guns together on a supporting member as has been the prior art practice. Discussion will be developed by taking a bipotential type multi-beam electron gun assembly hereinafter, but it should be noted that the present invention is not limited only to the bipotential type electron gun assembly.

FIG. 1 shows a three beam type electron gun assembly for use in a colour picture tube with the triangular arrangement consisting essentially of the first grid electrodes, 1A, 1B and 1C, the second grid electrodes 2A, 2B and 2C, the third grid electrode 34, at the fourth grid electrode 5 and a cathode electrode with a heater (not shown) associated with the first grid electrodes. These component elements are disposed at definite relative spacings and are secured to supporting members 6 such as beads glass, or the like. The first and second grid electrodes are provided for each electron gun. The third grid electrode 34 comprises a pair of opposed cup shaped members 3 and 4 with their abutting ends welded together. The bottom of the cup shaped member 4 is provided with three openings 4A, 4B and 4C corresponding to a predetermined arrangement of the electron guns. These openings are coaxial with opening 33 provided for axial projections 32 at the bottom of the cup shaped member 3 which extends into the interior of the second grid electrodes 2A, 2B and 2C (see FIG. 4). The fourth grid electrode 5 is also cup shaped and its bottom is provided with openings 5A, 5B, and 5C corresponding to the openings 4A, 4B and 4C at the bottom of the cup shaped member 4. Openings 4A, 4B and 4C and 5A, 5B and 5C are positioned to oppose each other with a predetermined spacing therebetween. These openings are surrounded by axially extending edges which are formed by pressing and having a height of h. As is well known in the art, this construction is effective to increase the breakdown voltage between opposing grid electrodes 34 and 5. This construction also improves the symmetry of the electric field between opposing openings although depending upon the height of the edge.

In the following description, it will be seen that the improved main focussing lens system is achieved with the integrally formed grid electrode according to this invention.

Figure 4:
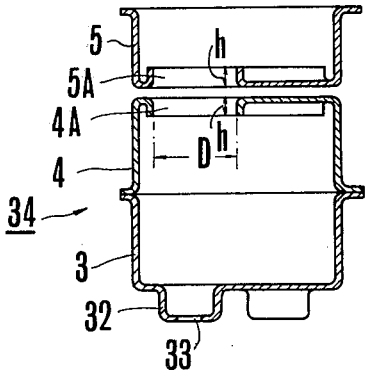
FIG. 4 PRIOR ART
FIG. 4 is a longitudinal sectional view of a prior art grid structure disposed to define a main electron lens.

The material of the grid electrode should be nonmagnetic, durable to heat encountered during use and fabrication, and should not adversely affect, either directly or indirectly, the phosphors of the picture tube. Further, it must be light, has excellent workability. However, it is difficult to obtain materials having all of these desirable characteristics. At present, the best one is nonmagnetic stainless steel containing 16% of chromium and 14% of nickel for example.

Where openings are provided for the bottoms of the cup shaped members 4 and 5 made of such material, the ratio of the inner diameter D of the opening to the height h of the edge formed by pressing is about $h/D$ 0.3. With this ratio, however, it is difficult to improve the symmetry of the electric field between opposed openings. More particularly, as shown in FIG. 4, the distance between an opening, for example 4A, of the cup shaped member 4 and the side wall of the opposing cup shaped member 5 is not equal around the opening, so that when a potential is impressed across them, the electric field established between opposed openings 4A and 5A is not uniform due to the fact that the distance between the opening 4A and the side wall of the cup shaped member and the distance between the opening 5A and the side wall of the cup shaped member 4 are not equal thus resulting in stigmatism of the main electron lens formed with third and fourth grid electrode which impairs the focussing characteristic of the electron beam. However, when the height h of the edge exceeds a certain limit, the adverse effect of the side wall upon the electric field between opposing openings can be eliminated thereby forming uniform electric field. It has been found that the value of the ratio $h/D$ enhancing this advantageous effect is generally $h/D$ 0.5.

According to this invention, this object of producing uniform electric field between opposed openings can be accomplished by providing a plate member having openings at predetermined positions for at least one of the end surfaces of the grid structures which are opposed to form the main electron lens.

Figure 5:
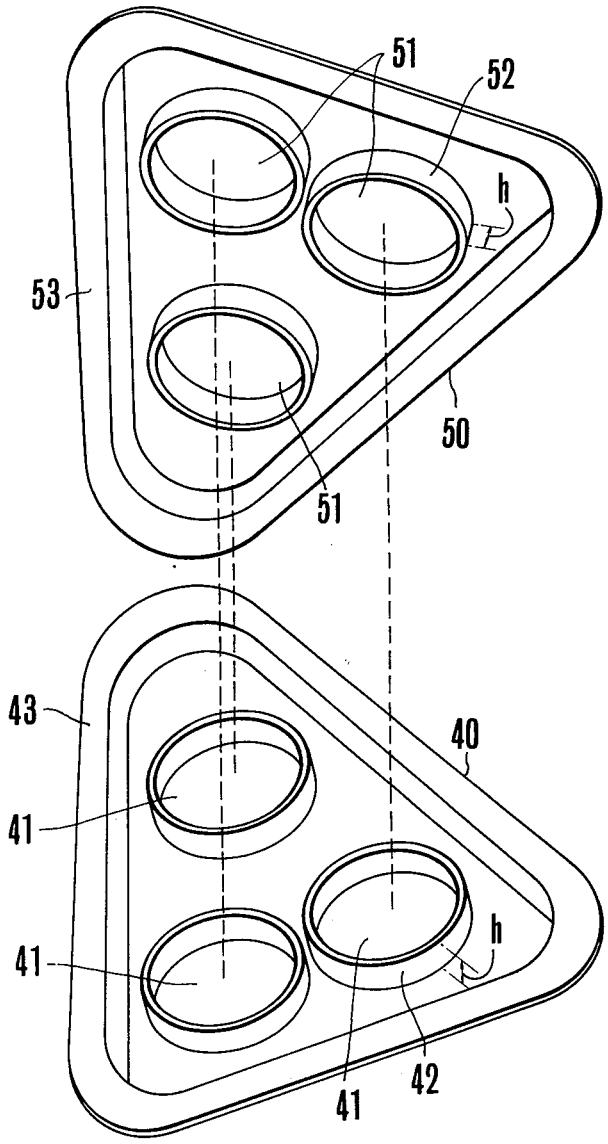
FIG. 5 is a perspective view of one example of the plate members embodying the invention.

FIG. 5 illustrates one example of the perforated plate member embodying the invention. Three openings 41 and 51 for respective plate members 40 and 50 are arranged in an equilateral triangular configuration, but it should be understood that these three openings can be arranged in-line.

Figure 6:
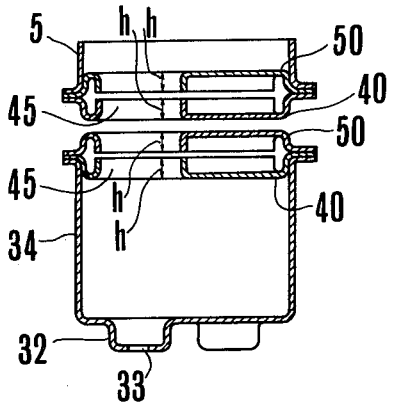
FIG. 6 is a longitudinal sectional view of an opposed grid structure provided with an assembly of the plate member shown in FIG. 5.
Figure 7:
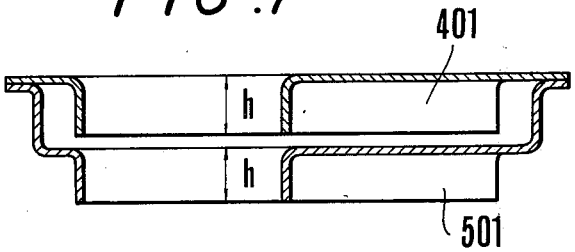
FIG. 7 is a sectional view of a modified example of the assembly of the plate members.

Respective openings are formed with axial edges 42 and 52, the maximum height *h* of which must be determined dependent upon the spacing between adjacent openings and the easiness of the pressing process corresponding to the characteristic of the material. After forming the openings and edges two plate members 40 and 50 are superimposed and welded together at their peripheries 43 and 53. Upon fabrication, edges 42 and 52 corresponding pair of openings are brought to oppose each other. Further as shown in FIG. 6 the plate members are welded to the opposing end surfaces of the cup shaped members 34 and 5. By interposing superposed plate members between opposing end surfaces of the cup shaped members 34 and 5, the effective height of the edges around opening 45 of the resulted grid electrode is increased beyond $2h$ thus effectively preventing the adverse effect of said interception. For this reason, it is possible to form uniform electric field between opposing openings. Although in this embodiment two plate members are joined with the edges opposed to each other it is also possible to join two plate members 401 and 501 with their edges directed in the same axial direction as shown in FIG. 7. With the later construction, it is also possible to increase the effective height of the edge beyond $2h$ and to establish uniform electric field between opposing openings. The construction of the plate members to be secured to the third grid electrode 34 and that of the plate members to be secured to the fourth grid electrode 5 may be different, adequate construction being determined by the characteristics of the electron gun.

Figure 3:
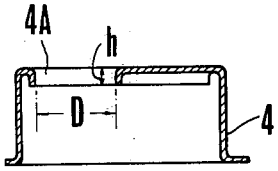
FIG. 3 PRIOR ART
FIG. 3 is a sectional view taken along a line III—III in FIG. 2 and shows the construction of the opening of the prior art grid structure.
Figure 8:
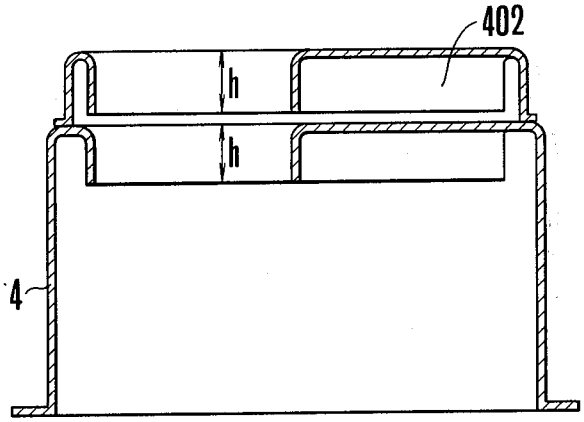
FIG. 8 is a sectional view of another modified embodiment of this invention.

FIG. 8 shows another embodiment of this invention. Two plate members have been adopted to increase the substantial depth of the peripheral edge of the opening thus far. However, according to the embodiment shown in FIG. 8, it is possible to make the edge height substantially twice by superposing a single plate member 402 upon the grid electrode 4, and to establish uniform electric field between opposing openings. In this case, prior art cup shaped members 4 and 5 in FIGS. 3 and 4 can be used without any modification thereof so that the unnecessary tooling is effectively avoided. Needless to say, this member 402 is applicable for the grid 5 in the same manner shown in FIG. 8.

Further, the invention has been described in terms of a bipotential type electron gun assembly arranged in a triangular configuration the invention is also applicable to electron gun assemblies of the in-line type and unipotential type.

Further, in the illustrated example, although the assembly of the perforated plate members of this invention was secured to both of the third grid electrode 34 and the fourth grid electrode, this invention is not limited to this specific construction but instead the assembly of the perforated plate member may be secured to either one of the third and fourth grid electrodes.

The invention can also be applied to an electron gun assembly wherein the fourth grid electrode is displaced in the radial direction with respect to the third grid electrode for the purpose of providing a convergence effect or an electron gun assembly of the type wherein a convergence electrode is attached on one end of the assembly for the purpose of providing a convergence effect.

Instead of making equal the height of the edges of the plate members 40 and 50, the height may be different for different plate. It is only necessary to make the sum of the height of the edges provided for the plate members 40 and 50 to be larger than the height h of the edge of the prior art construction shown in FIGS. 3 and 4.

The above embodiment is explained in terms of the grid which constitutes the main focussing lens system but it should be noted that this invention is applicable to the grid other than the grid constituting other lens system.

As described herein above, in the electron gun assembly embodying the invention, since the height of the axial edges surrounding the openings of the grid structures which are used to form a main electron lens is increased sufficient to make astigmatism of the main electron lens be negligibly small thus producing clear picture images.

What is claimed is:

1. A multi beam type electron gun assembly for use in a cathode ray tube comprising a plurality of electron guns including a plurality of cathode electrodes emanating electron beams directed toward a fluorescent screen and a plurality of grid electrode structures which are constituted with a plurality of common electrodes comprising each grid electrode which has identical function in respective electron guns, said common electrodes being formed integrally, one of said common electrodes comprising a hollow side wall member forming an enclosure surrounding all paths of the electron beams and an end member, said end member comprising two plate members, each plate member having a plurality of openings being used for the passage of the electron beams and each opening being provided with an axially extending peripheral flange formed integrally along the respective peripheries of said openings, said flanges being close-aligned respectively by superposing said plate members with each other to have an aggregate axial height at least not less than half the diameter of said opening, whereby an electric field occurred in the neighborhood of said openings is prevented from being adversely affected by the side wall member.

2. The multi-beam type electron gun assembly according to claim 1 wherein said side wall member and one of said plate members are formed as a cup shaped integral unit.

3. A multi-beam type electron gun assembly according to claim 1 wherein said side wall member and said plate members comprising a common electrode are formed respectively as a unit.

4. The multi-beam type electron gun assembly according to claim 1 wherein said plate members are superposed each other such that said edge of respective plate members oppose each other.

5. The multi-beam electron gun assembly according to claim 1 wherein said plate members are superposed each other such that said edges of different plate members extend in the same direction.

6. The multi-beam electron gun assembly according to claim 1 wherein said plate members are mounted on both opposing ends of the adjacent grid structures.

7. The multi-beam electron gun assembly according to claim 1 wherein a main focussing lens is formed between openings opposing each other.

* * * * *